US009883576B2

(12) United States Patent
Kovaleski et al.

(10) Patent No.: US 9,883,576 B2
(45) Date of Patent: Jan. 30, 2018

(54) LOW-POWER, COMPACT PIEZOELECTRIC PARTICLE EMISSION

(71) Applicant: The Curators of the University of Missouri, Columbia, MO (US)

(72) Inventors: Scott D. Kovaleski, Columbia, MO (US); Brady B. Gall, Columbia, MO (US); Andrew L. Benwell, Columbia, MO (US); Peter Norgard, Columbia, MO (US); James Vangordon, Columbia, MO (US)

(73) Assignee: The Curators of the University of Missouri, Columbia, MO (US)

( * ) Notice: Subject to any disclaimer, the term of this patent is extended or adjusted under 35 U.S.C. 154(b) by 225 days.

(21) Appl. No.: 14/898,438

(22) PCT Filed: Jun. 13, 2014

(86) PCT No.: PCT/US2014/042349
§ 371 (c)(1),
(2) Date: Dec. 14, 2015

(87) PCT Pub. No.: WO2015/047473
PCT Pub. Date: Apr. 2, 2015

(65) Prior Publication Data

US 2016/0120016 A1 Apr. 28, 2016

Related U.S. Application Data

(60) Provisional application No. 61/964,659, filed on Jan. 10, 2014, provisional application No. 61/835,253, filed on Jun. 14, 2013, provisional application No. 61/997,261, filed on May 27, 2014.

(51) Int. Cl.
*H05H 3/06* (2006.01)
*H01J 35/14* (2006.01)
(Continued)

(52) U.S. Cl.
CPC ..... *H05H 3/06* (2013.01); *H01J 35/06* (2013.01); *H01J 35/065* (2013.01); *H01J 35/14* (2013.01);
(Continued)

(58) Field of Classification Search
CPC ..... H05G 2/001; B82Y 20/00; G03F 7/7003; G03F 1/003; G03F 1/00; H01J 35/32; H01J 7/252; H01J 37/252; H02J 5/003
(Continued)

(56) References Cited

U.S. PATENT DOCUMENTS 3,562,792 A 6/1968 Berlincourt et al.
3,662,194 A 5/1972 Moriki et al.
(Continued)

OTHER PUBLICATIONS

Nakamura, Kiyoshi, Piezoelectric Applications of Ferroelectric Single Crystals, article, Department of Electrical and Communication Engineering, Graduate School of Engineering, Tohoku University, Aoba 05, Aramaki, Aoba-ku, Sendai 980-8579, Japan, 0-7803-7414-2/02, © 2002 IEEE.
(Continued)

*Primary Examiner* — Don Wong
(74) *Attorney, Agent, or Firm* — Senniger Powers LLP

(57) ABSTRACT

A low-power, compact piezoelectric particle emitter for emitting particles such as X-rays and neutrons. A piezoelectric transformer crystal receives an input voltage at an input end and generates a higher output voltage at an output electrode disposed at an output end. The emitter is in a vacuum and the output voltage creates an electric field. A charged particle source is positioned relative a target such that charged particles from the charged particle source are accelerated by the electric field toward the target. Interaction between the accelerated charged particles and the target causes one of X-rays and neutrons to be emitted.

20 Claims, 7 Drawing Sheets

(51) Int. Cl.

| | |
|---|---|
| ***H01J 35/06*** | (2006.01) |
| ***H05G 1/10*** | (2006.01) |
| *H05G 1/06* | (2006.01) |
| *H05H 1/24* | (2006.01) |

(52) U.S. Cl.
CPC ..... *H05G 1/10* (2013.01); *H01J 2235/02* (2013.01); *H05G 1/06* (2013.01); *H05H 2001/2481* (2013.01)

(58) Field of Classification Search
USPC ..... 378/101, 119, 102, 120
See application file for complete search history.

(56) References Cited

U.S. PATENT DOCUMENTS

| | | | | |
|---|---|---|---|---|
| 3,735,161 | A | 5/1973 | Perkins et al. | |
| 5,763,983 | A | 6/1998 | Huang | |
| 5,959,835 | A | 9/1999 | Uhm et al. | |
| 6,111,933 | A | 8/2000 | Schaaf et al. | |
| 6,540,655 | B1 | 4/2003 | Chin et al. | |
| 6,661,876 | B2 | 12/2003 | Turner et al. | |
| 9,723,704 | B2 * | 8/2017 | Tang | H05H 3/06 |
| 2006/0274889 | A1 | 12/2006 | Lu et al. | |
| 2009/0046823 | A1 * | 2/2009 | Edwards | H05H 3/06 376/114 |
| 2010/0232559 | A1 | 9/2010 | Takeishi et al. | |
| 2011/0044418 | A1 | 2/2011 | Stubbers et al. | |

OTHER PUBLICATIONS

Benwell, A, A resonantly driven piezoelectric transformer for high voltage generation, article, Department of Electrical and Computer Engineering, University of Missouri, Columbia, MO, 1-4244-1535-7/08, © 2008 IEEE.

Vangordon, J.A., High Voltage Production from Shaped Piezoelectric Transformers and Piezoelectric Transformer Based Circuits, article, Electrical and Computer Engineering Department, University of Missouri, Columbia, MO 65201, kovaleksis@missouri.edu,, 978-1-4244-7129-4/10, © 2010 IEEE.

Vangordon, J.A., Electrical Analysis of Piezoelectric Transformers and Associated High-Voltage Output Circuits, article, University of Missouri, 349 Engineering Building West, Department of Electrical and Computer Engineering, Columbia, MO 65211, 978-1-4577-0631-8/12, © 2011 IEEE.

Gall, Brady, Investigation of the Piezoelectric Effect as a Means to Generate X-Rays, article, IEEE Transactions on Plasma Science, vol. 41. No. 1 Jan. 2013, 0093-3813, © 2012 IEEE.

Travish, Gil, Addressable flat-panel x-ray sources for medical, security and industrial applications, article, UCLA Department of Physics & Astronomy, Los Angeles, CA 90095, Radius Diagnostics Research, Inc., Los Angeles, CA 90095, Ali M. Khounsary, Proc. of SPIE vol. 8502, 85020L-1- © SPIE.

Hutsel, Brian T., Optimization of Piezoelectric Resonance Effect in a Piezoelectric Transformer Plasma Source, article, IEEE Transactions on Plasma Science, vol. 41, No. 2, Feb. 2013, 0093-3813, © 2013 IEEE.

Lineykin et al., "Feedback Isolation by Piezoelectric transformers: comparison of amplitude and frequency modulation." HAIT Journal of Science and Engineering B, vol. 2, Issues 5-6, pp. 830-847, 2005 (2005), abstract [online] URL=<http://people.clarkson.edu/-nanosci/jse/B/vol0236B/jse13.pdf>.

International Search Report and Written Opinion for related application PCT/US 14/42349; dated Mar. 12, 2015.

* cited by examiner

LOW-POWER, COMPACT PIEZOELECTRIC PARTICLE EMISSION

CROSS REFERENCE TO RELATED APPLICATIONS

The present application claims priority to and is a National Phase Entry of International Application Number PCT/US14/042349, filed Jun. 13, 2014, which claims priority to U.S. Provisional Application No. 61/835,253, which was filed on Jun. 14, 2013, U.S. Provisional Application No. 61/964,659, which was filed on Jan. 10, 2014, and U.S. Provisional Application No. 61/997,261, which was filed May 27, 2014, the disclosures of which are incorporated by reference herein in their entirety.

GOVERNMENT LICENSE RIGHTS

This invention was made with Government support under Grant Nos. 85083-001-10, awarded by the Los Alamos National Laboratory, and N00014-13-1-0238, awarded by the Office of Naval Research. The Government has certain rights in the invention.

FIELD OF THE INVENTION

The present invention generally relates to low-power, compact piezoelectric particle emission, and more particularly, to an apparatus or system using a high voltage piezoelectric transformer to emit X-rays or neutrons.

BACKGROUND OF THE INVENTION

In many industries, X-ray sources or neutron sources may provide useful information about the quality or nature of a material or object. For example, large, high-powered technologies such as linear accelerators, synchrotrons, and free-electron lasers are often used to produce X-rays in scientific research. Likewise, nuclear reactors, fusors, and gas discharge tubes have been used as neutron sources in nuclear activation analyses. Each of the above-mentioned technologies is large and consumes a significant amount of power. Accordingly, the information gathering capabilities of X-ray and neutron sources is unavailable for use in confined spaces and in more remote locations. Efficient particle emitters have other applications, including without limitation, use in ion propulsion.

SUMMARY

In one aspect, the present invention includes a low-power, compact emitter of atomic particles comprising a piezoelectric transformer crystal formed from a piezoelectric material having an input end and an output end. An output electrode is electrically connected to the output end. A voltage source is electrically connected to the input end to apply a first voltage to the crystal and create a second voltage that is higher than the first voltage at the output end caused by the piezoelectric effect. The second voltage creates an electric field generally at the output electrode. A charged particle source emits charged particles. A target for receives the charged particles. The emitter further comprises an electric field shaper. A vacuum chamber contains the piezoelectric transformer crystal, the charged particle source and the target. In operation, the electric field accelerates the charged particles toward the target such that the charged particles interact with the target to emit one of neutrons and X-rays.

In another aspect, the present invention includes a low-power, compact piezoelectric neutron generator comprising a piezoelectric transformer crystal formed from a piezoelectric material having an input end and an output end. An output electrode is electrically connected to the output end. A voltage source is electrically connected to the input end to apply a first voltage to the crystal and create a second voltage that is higher than the first voltage at the output end caused by the piezoelectric effect. The second voltage creates an electric field generally originating at the output electrode. An ion source is configured to produce a plurality of ions. The ions are accelerated as an ion beam by the electric field. The ion beam has an ion beam path. An ion target is electrically connected to the output electrode. The ion target is positioned in the ion beam path so that the charged particles interact with the ion target to generate neutrons. A vacuum chamber contains the piezoelectric transformer crystal, the ion source, and the ion target.

In another aspect, the present invention includes a low-power, compact piezoelectric X-ray generator comprising a piezoelectric transformer crystal formed from a piezoelectric material having an input end and an output end. An output electrode is electrically connected to the output end. A voltage source is electrically connected to the input end to apply a first voltage to the crystal and create a second voltage that is higher than the first voltage at the output end caused by to the piezoelectric effect. The second voltage creates an electric field generally at the output electrode. An electron emitter comprises a thermionic emitter spaced apart from the output end of the piezoelectric transformer crystal and configured to emit a beam of electrons accelerated by the electric field. A bremsstrahlung target is disposed at the output end of the piezoelectric transformer crystal and positioned in the electron beam so that the electrons interact with the target to generate X-rays. A vacuum chamber contains the piezoelectric transformer crystal, the electron emitter and the bremsstrahlung target.

In another aspect, the present invention includes a low-power, compact emitter of atomic particles comprising a piezoelectric transformer crystal formed from a piezoelectric material having an input end and an output end. An output electrode is electrically connected to the output end. A voltage source is electrically connected to the input end to apply a first voltage to the crystal and create a second voltage higher than the first voltage at the output end caused by the piezoelectric effect. The second voltage creates an electric field generally at the output electrode. A charged particle source emits charged particles, and a target receives the charged particles. The electric field accelerates the charged particles toward the target such that the charged particles interact with the target to emit one of neutrons and x-rays. The emitter is in a vacuum.

In another aspect, the present invention includes a low-power, compact piezoelectric X-ray emitter comprising a piezoelectric transformer crystal formed from a piezoelectric material having an input end and an output end. An output electrode is electrically connected to the output end. A voltage source is electrically connected to the input end to apply a first voltage to the crystal and create a second voltage higher than the first voltage at the output end caused by the piezoelectric effect. The second voltage creates an electric field generally at the output electrode. An electron emitter is configured to emit a beam of electrons accelerated by the electric field. A bremsstrahlung target is positioned in the electron beam so that the electrons interact with the target to generate X-rays. The X-ray emitter is in a vacuum.

Other aspects of the present invention will be apparent in view of the following description and claims.

BRIEF DESCRIPTION OF THE DRAWINGS

Corresponding reference characters indicate corresponding parts throughout the drawings.

DETAILED DESCRIPTION OF THE DRAWINGS

Figure 1:
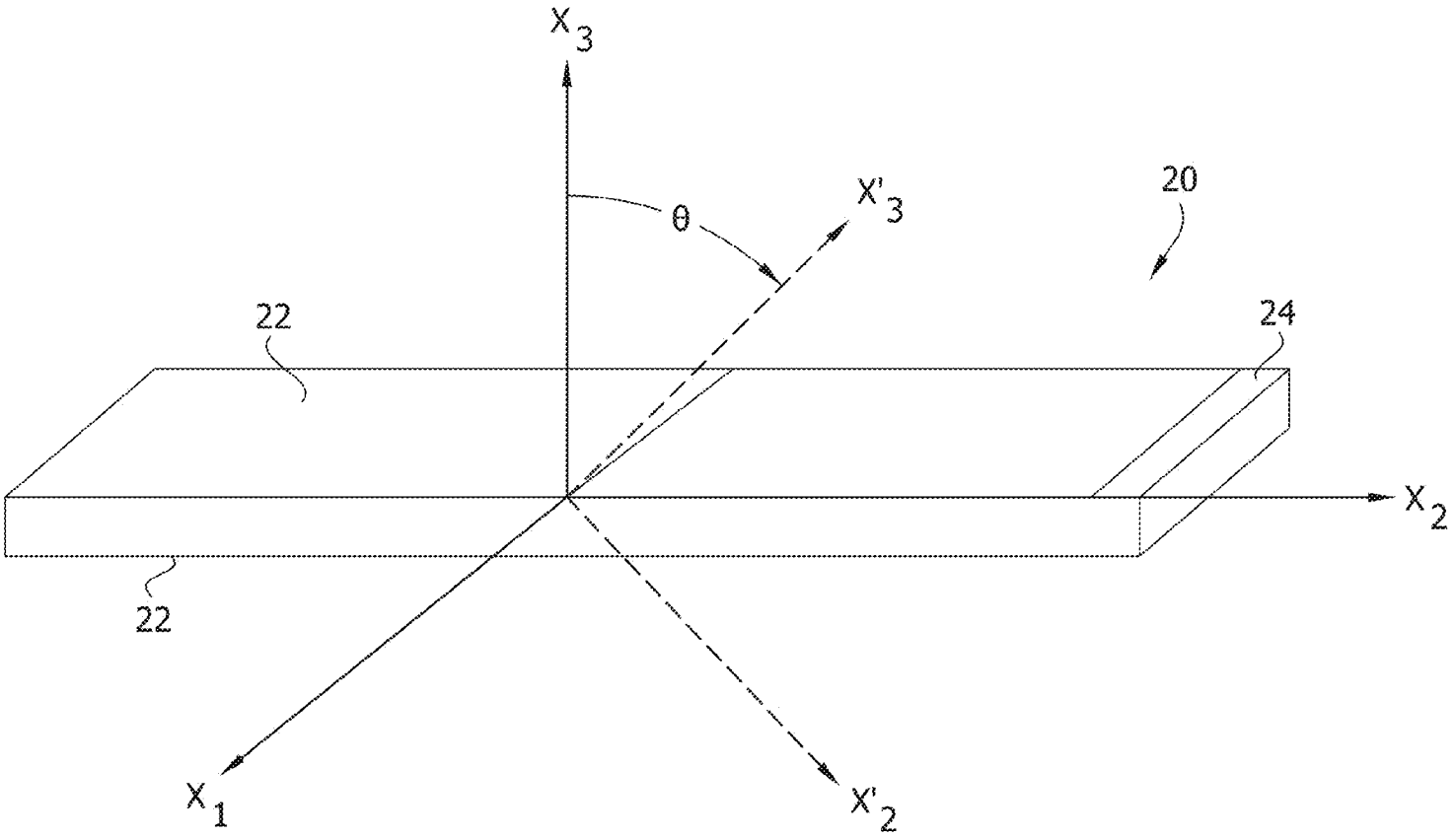
FIG. 1 is a perspective of a piezoelectric transformer of an embodiment of the present invention.

Referring to FIG. 1, a piezoelectric transformer of a first embodiment of the present invention is illustrated and generally indicated at reference numeral 20. A piezoelectric transformer, like the transformer 20, may be used to multiply voltage received from an alternating current voltage source. Thus, by applying an alternating current to a piezoelectric crystal, a transformer crystal may multiply the input voltage of the current to a much higher output voltage. As the alternating current voltage is applied to the piezoelectric crystal, the inverse piezoelectric effect creates alternating stresses in the crystal. This in turn causes the crystal to vibrate, and the direct piezoelectric effect creates a higher (under certain circumstances, much higher) output voltage at the output of the crystal. Generally, the piezoelectric effect may be used to step up the voltage inputted into a piezoelectric crystal by way of an alternating current.

In the illustrated embodiment, a piezoelectric transformer 20 is formed from a block of piezoelectric material. The transformer has an input end and an output end corresponding respectively with input electrodes 22 and an output electrode 24. The input electrodes 22 are attached to the top and bottom surfaces of the input end of the transformer 20 and extend approximately half the length of the transformer across its entire width. The output electrode 24 is attached only to the top surface of the electrode, and extends along only a very short length of the transformer across its entire width. Other configurations of the electrodes are possible. Though the illustrated electrodes 22 and 24 are physically attached to the transformer 20, it should be understood that other ways of electrically connecting the electrodes with the transformer can also be used.

The piezoelectric transformer 20 is characterized by a pair of piezoelectric coupling coefficients that represent the relative effectiveness of the transformer at the direct and inverse piezoelectric effects. One piezoelectric coupling coefficient represents the square root of the ratio of available electric energy produced relative to an input mechanical energy (direct piezoelectric effect), and another coefficient represents the square root of the ratio of available energy produced in mechanical form relative to an input electric energy (inverse piezoelectric effect). To maximize the electric transformation of the piezoelectric transformer 20, which operates using both the direct and indirect piezoelectric effects, the crystal should be configured so as to maximize the product of the pair of piezoelectric coupling coefficients.

One characteristic of the piezoelectric transformer 20 that can be chosen to maximize electric transformation (i.e., the extent to which the second output voltage exceeds the first input voltage) is material. In a preferred embodiment, the transformer 20 may be formed of lithium niobate, the piezoelectric material properties of which are well known in the art. However, alternative suitable piezoelectric materials may also be used without departing from the scope of the invention.

Another characteristic of the piezoelectric transformer 20 that can be chosen to maximize electric transformation is crystallographic orientation. The primary geometric axes of the transformer 20, as shown in FIG. 1, are $x_1$, $x_2$, and $x_3$. The transformer crystal 20 has a length extending in the $x_2$ direction, a width extending in the $x_1$ direction, and a height extending in the $x_3$ direction. The secondary axes $x'_2$ and $x'_3$ are rotated by an angle $\theta$ about the primary axis $x_1$ (i.e., a widthwise axis). This rotation indicates the crystallographic polarization direction of the transformer crystal 20. Electric fields in the $x_3$ direction cause mechanical displacements in the $x_2$ direction as a result of the rotated polarization. This causes electric transformation in a length extensional mode. To maximize the product of the piezoelectric coupling coefficients, the $x'_3$ axis is rotated 50° from the vertical $x_3$ axis (i.e., $\theta$=50°). Though a 50° rotation angle is preferred, the design can tolerate deviations of several degrees (e.g., up to about ±10° or up to about ±5°) without substantial degradation of performance. Thus, for example, a 45° rotation angle can be chosen to simplify manufacturing of the transformer. It should be understood that other crystallographic orientations can also be used without departing from the scope of the invention.

The frequency of the alternating current applied to the transformer 20 also affects its transformational capabilities. To maximize the electric output of the transformer 20, it should be driven with an alternating current of a frequency at or near the resonant frequency of the transformer, or an integer multiple thereof. In addition to the improvements in electric output, driving the transformer 20 at its resonant frequency or an integer multiple thereof also facilitates mounting the transformer. When the transformer 20 is driven at its resonant frequency or an integer multiple thereof, mechanical nulls develop at fixed points along the length of the transformer 20. At these nulls, little or no vibration occurs. For example, when the transformer 20 is driven at its resonant frequency (hereinafter, "mode 1"), one mechanical null develops at its mid length. When the transformer is driven at two-times its resonant frequency (hereinafter, "mode 2"), two mechanical nulls develop: the first at its quarter length and the second at its three-quarters length.

Figure 2:
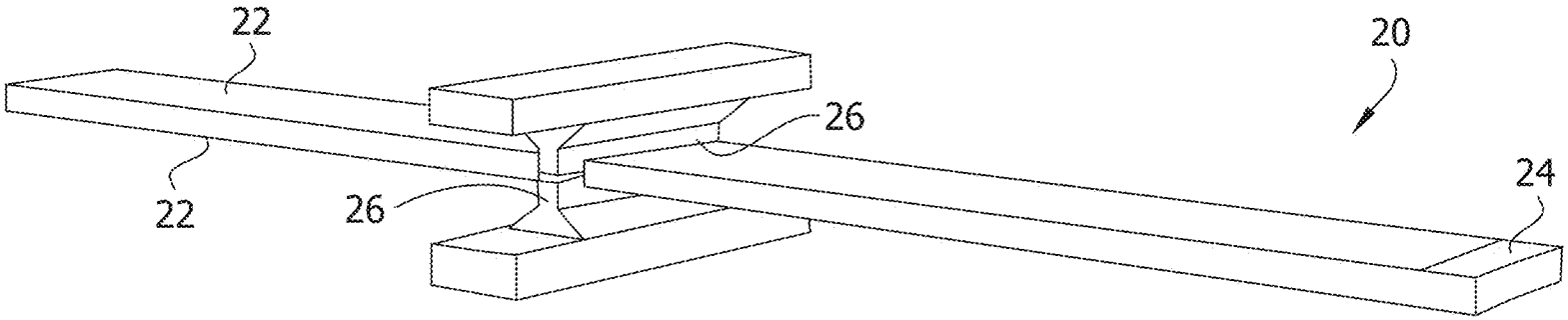
FIG. 2 is a perspective of an embodiment of a mode 1 mounting system for the piezoelectric transformer of FIG. 1.
Figure 3:
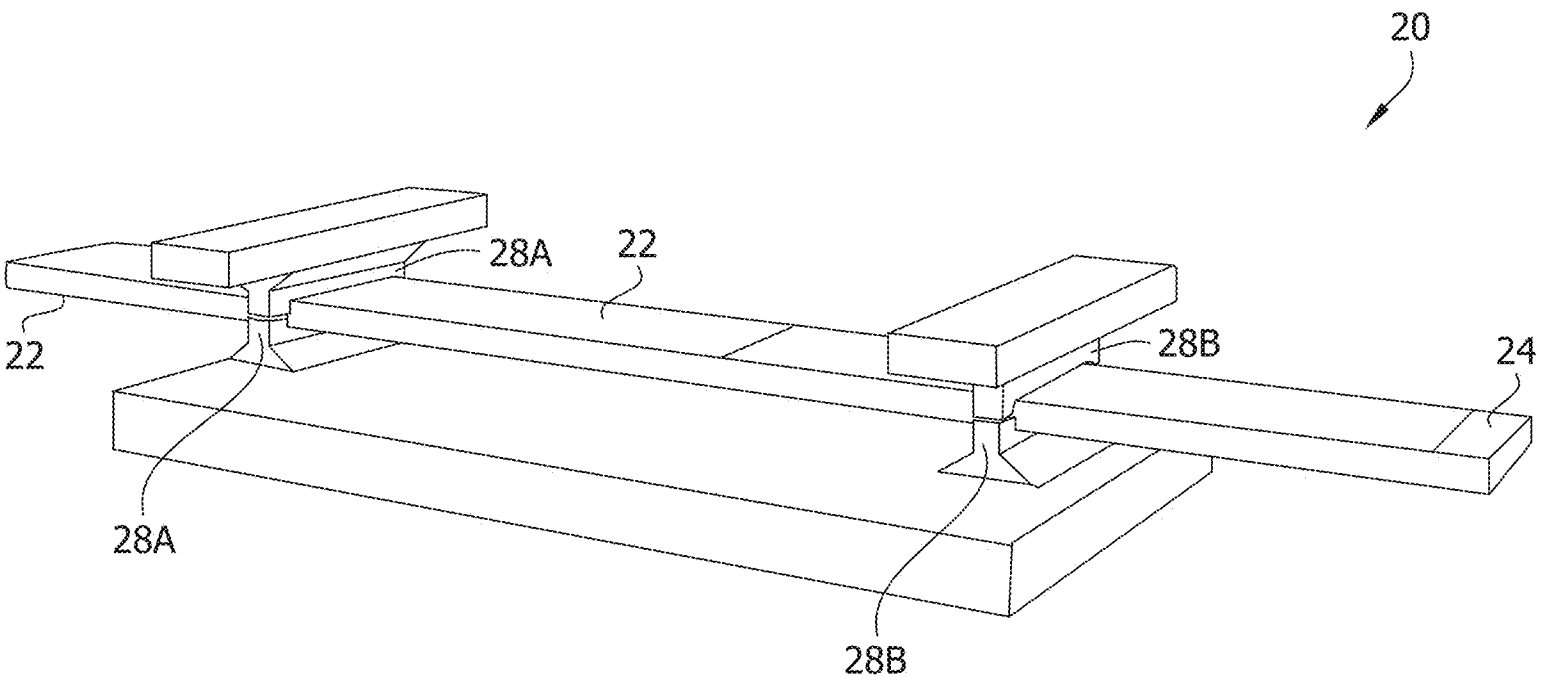
FIG. 3 is a perspective of an embodiment of a mode 2 mounting system for the piezoelectric transformer of FIG. 1.

Proper mounting of the piezoelectric transformer 20 can improve its electric transformation. Once mounted, the vibration in the transformer 20 can build charge effectively. In a preferred embodiment, the mounting system should be designed to hold the transformer in place while minimizing the extent to which it restrains the vibration of the crystal. FIGS. 2 and 3 illustrate two embodiments of mounting systems for the transformer 20 when it is driven in modes 1 and 2 respectively. In FIG. 2, the transformer 20 is mounted by way of opposed knife-edge brackets 26 that grip transformer 20 at its mid length. The brackets 26 may be formed of acrylic material shaped on a 3-D printer. However, other materials and manufacturing processes may also be used without departing from the scope of the invention. In FIG. 3, the transformer 20 is mounted by way of two opposed knife-edge brackets 28A and 28B, respectively gripping the transformer at its quarter length and at its three-quarters length (i.e., the location of nulls when the transformer is driven in mode 2). Other mounting structures besides knife-edge brackets may also be used without departing from the scope of the invention. For example, any of knife-edge brackets 26, 28A, and 28B may be replaced an expanded polymer sponge or any other suitable mounting device. Portions of the brackets 28A, 28B are located on the sides of the transformer to prevent rotation of the transformer about a vertical axis. Moreover, the brackets 28A, 28B may be spring loaded for resilient movement in vertical directions within the scope of the present invention.

In one embodiment, the input and output electrodes 22 and 24 are formed of silver paint applied to the surface of the transformer 20. In another embodiment, electrodes are patterned using deposition techniques. Other electrically conductive electrodes may also be used without departing from the scope of the invention. An alternating current source (not shown) may be electrically connected to the input electrodes 22 to energize the transformer crystal 20. As discussed above, the applied alternating current causes the transformer crystal 20 to vibrate due to alternating stresses produced by the inverse piezoelectric effect in the crystal. Moreover, due to the piezoelectric effect in the transformer crystal 20, a second voltage that is higher than the first voltage is created at the output electrode 24.

In an ideal scenario, to maximize the output voltage from the transformer 20, the alternating current would be applied continuously, at a maximum amplitude and constant frequency (i.e., the resonant frequency or integer multiple thereof), to the input electrodes 22, at a 100% duty factor. However, in practice, continuous operation of the transformer 20 will break the crystal. One alternative to continuous application of the alternating current is to apply the alternating current (i.e., at maximum amplitude and constant frequency) to the input electrodes 22 in a pulsed mode. Applying the alternating current at a constant frequency and amplitude in a pulsed mode produces a low duty factor. Another alternative to a continuous alternating current input is amplitude modulation of the input current. With this technique, the amplitude of the input alternating current is modulated periodically. In a preferred embodiment, the amplitude of the alternating current input is modulated periodically between 0% and 100% of the maximum amplitude applied to the crystal in the pulsed mode. One hundred percent duty factor can be achieved when the amplitude of the alternating current input is modulated without breaking the crystal. Yet another alternative to a continuous alternating current input is a frequency modulated alternating current input. As discussed above, the alternating current supplied to the input electrodes 22 of the transformer 20 is preferably applied at the resonant frequency or an integer multiple thereof. In a frequency-modulated input mode, the frequency of the alternating current input is periodically modulated between a high frequency slightly above the resonant frequency or integer multiple thereof (e.g., +2 kHz) to a low frequency slightly below the resonant frequency or integer multiple thereof (e.g., −2 kHz). The frequency modulated input mode can be run at a 100% duty factor without breaking the crystal. As will be discussed in greater detail below, the amplitude and frequency modulated modes of driving the crystal 20 produce an electric field for a longer duration of time compared to pulsed mode, thereby leading to the generation of higher quantities of radiations such as X-rays.

In one preferred embodiment, the invention includes a mounted piezoelectric transformer 20 and a charged particle source for emitting charged particles. Several embodiments of charged particle sources are discussed in more detail below. Preferably, the transformer 20 is configured to create an electric field generally at its output electrode 24. In certain embodiments the electric field produced by the transformer 20 can be managed by an electric field shaper, as discussed in more detail below. The electric field can be configured to accelerate the charged particles from the charged particle source toward a target. The target is configured to emit one of neutrons or X-rays when the charged particles strike the target. Moreover, as discussed in more detail below, the transformer 20, the charged particle source, and the target are preferably maintained in a vacuum. In one embodiment, the charged particles are electrons and the target is a bremsstrahlung target. In this embodiment, the electrons are accelerated toward the bremsstrahlung target to cause the target to emit X-rays. In another embodiment ions from an ion source are accelerated toward an ion source target. The ions interact with the ion source target to cause neutrons to be emitted. In one embodiment, the charged particle source is positioned at the output electrode 24 of the transformer 20, and the target is spaced apart therefrom (see, for example, the discussion of FIG. 4 infra). In an alternative embodiment, the target is positioned at the output electrode 24 of the transformer 20, and the charged particle source is spaced apart therefrom (see, for example, the discussion of FIG. 5 infra).

Preferably, the transformer 20 is positioned in a vacuum chamber 34 maintained during operation at pressures of $9\times10^{-3}$ torr or less. For purposes of the present description a vacuum will be considered to be an environment where the pressure is less than atmospheric. At higher pressures, ionized gas may act as a low impedance path and reduce the output voltage of the piezoelectric transformer. By maintaining pressure below 9 mTorr, high output voltage is achievable since low impedance paths to ground are essentially eliminated. Additionally, to maintain high voltage output from the transformer 20, the electrostatic environment should be properly maintained. To do so, preferably, electrically connected metallic surfaces should be positioned no closer than 1 cm away from the transformer, where electrically connected means any connection that allows for the transmission of electrical energy by electrical conduction, capacitive coupling, or any other means.

As will be discussed in greater detail in reference to FIG. 6, in certain embodiments of particle emitters, an electric field shaper can be used in combination with a piezoelectric transformer to manage the electric field produced by the transformer. Though certain of the illustrated embodiments of particle emitters do not include field shapers, it should be understood that a field shaper can be used with these embodiments without departing from the scope of the invention.

Figure 4:
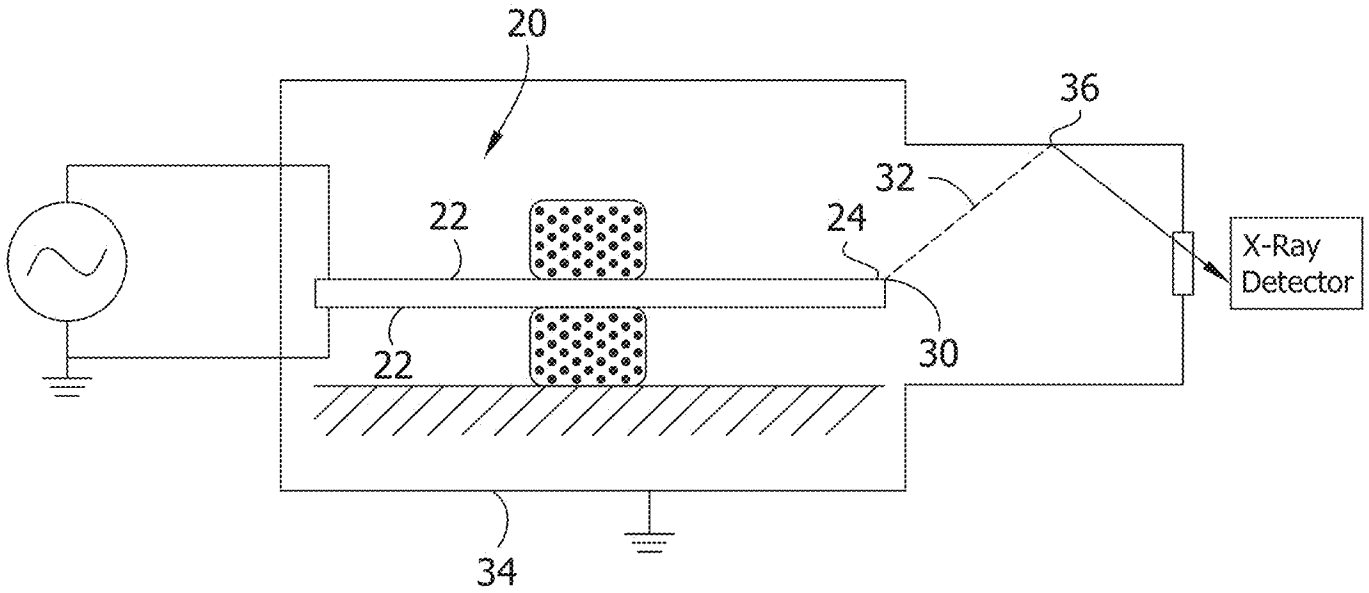
FIG. 4 is a schematic elevation of the piezoelectric transformer of FIG. 1 applied in an X-ray emitter setup.

Referring to FIG. 4, the piezoelectric transformer 20, which was discussed above in reference to FIGS. 1-3, is shown mounted in a mode 1 configuration arranged for emitting X-ray radiation. A high field electron emitter 30 is mechanically and electrically connected to the output electrode 24 by conductive adhesive. The high field electron emitter 30 may comprise, in one embodiment, an atomically sharp metallic or semiconducting material. The electric field at the output 24 of the transformer 20 is enhanced at the atomically sharp point. Preferably, an atomically sharp emitter 20 has a tip having a radius of no more than a few atoms. In a preferred embodiment, the high field emitter 30 includes several atomically sharp points at the output electrode 24. The high field at the atomically sharp points overcomes the forces binding electrons to the atoms that make up the atomically sharp point. The high voltage electromagnetic field produced by the transformer 20 and enhanced by the field emitter 20 reaches on the order of $10^6$ V/cm or more at the tip of the emitter. The electrons are extracted from the emitters 20 and formed into a beam. In one preferred embodiment, the emitter 30 comprises one or more short lengths of platinum-iridium wire that are coupled to the output electrode with silver paint. In a preferred embodiment, each length of platinum-iridium wire has a diameter of about 0.1 mm at its base and tapers to a point of no more than a few atoms in radius. Other high field electron emitters may also be used without departing from the scope of the invention. It should be understood that, though the illustrated embodiment does not depict an electric field shaper, the emitter 10 can be used with an electric field shaper to improve X-ray emission.

Figure 6:
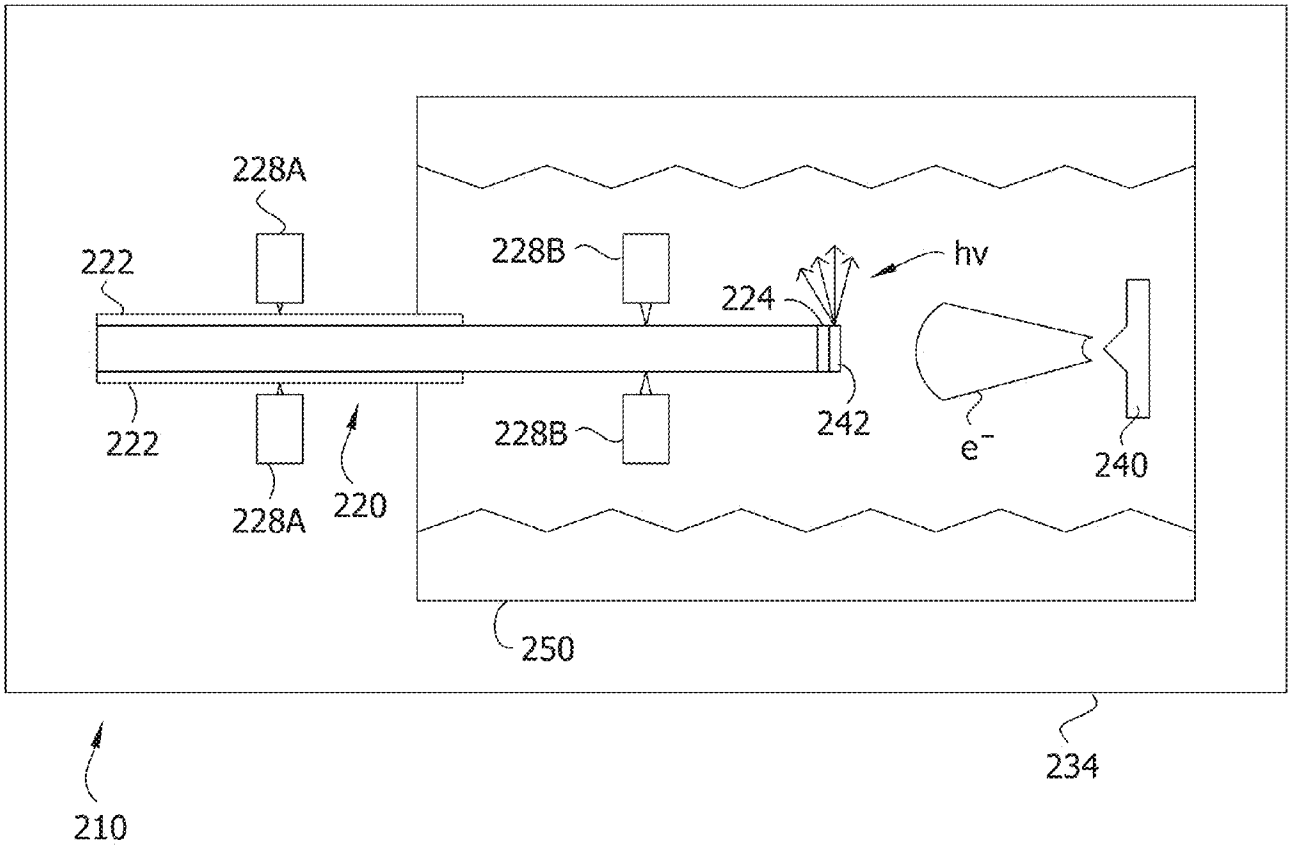
FIG. 6 is a schematic representation of a piezoelectric transformer in combination with a thermionic electron emitter and electric field shaper.

Vacuum conditions are especially important in the embodiments of FIGS. 4 and 6 because higher pressures will reduce the mean free path of the electron beam such that the majority of the particles will not reach the bremsstrahlung conversion target, thus halting X-ray production. By maintaining pressure at or below 9 mTorr, electron to X-ray conversion efficiency is high because the mean free path of the beam is greater than the separation distance between emitter and target. For example, in the embodiment of FIG. 4, transformer 20 is positioned in a vacuum chamber 34 maintained during operation at pressures of $9\times10^{-3}$ torr or less. Under this vacuum condition, the electron beam 32 will have a largely uninhibited electron beam path made up of a plurality of accelerated electrons. The X-ray emitter includes a bremsstrahlung target 36, which, as illustrated, may be positioned in the electron beam path 32. Within the vacuum chamber 34, the piezoelectric transformer 20 should be positioned such that the accelerated electrons of the electron beam 32 interact with the target 36 to produce X-rays. Any suitable bremsstrahlung target can be used with the embodiment of FIG. 4.

Bremsstrahlung radiation is well known in the art, as is the class of materials usable as bremsstrahlung targets. Accordingly, any material suitable for use as a bremsstrahlung target may be chosen without departing from the scope of the invention. Moreover, some bremsstrahlung targets may reflect radiation, as in the illustrated embodiment, while others may transmit radiation. Either transmissive or reflective bremsstrahlung targets may be used without departing from the scope of the present invention. In some embodiments, the unmodified stainless steel walls of a vacuum chamber act as the bremsstrahlung target. Alternatively, a dedicated target material may be used as a standalone component or may be attached within the vacuum chamber without departing from the scope of the invention.

It bears briefly mentioning the specifications and effectiveness of the particular embodiment of the invention illustrated in FIG. 4 that has been subjected to testing. A 100 mm×10 mm×1.5 mm, block of lithium niobate was selected for use as a piezoelectric transformer. The block had a crystallographic polarization direction rotated −45° from vertical about its widthwise axis. Electrodes are applied using silver paint with a thickness of 50 μm. The transformer was mounted at its midpoint using an expanded polymer sponge. These same transformer characteristics can also be used in any of the other emitter embodiments discussed herein. The high field electron emitters of the embodiment of FIG. 4 are fabricated from 0.1 mm-diameter platinum-iridium wire with a length of approximately 1 mm and were attached to the output electrode using silver paint. The transformer was activated at a mode 1 frequency of between 30.6 and 30.9 kHz (based on the modeled resonant frequency of the transformer). The alternating current was applied in a pulsed mode at approximately 79 mA, and an amplifier was used to amplify the drive voltage to between 11-16 $V_{max}$. The electron beam produced by the transformer intersected with the stainless steel walls of the vacuum chamber in which it was positioned. The chamber was maintained at a pressure of 770 μTorr, and the transformer was spaced at least 1.5 cm away from any electrically grounded metallic surface of the chamber. No electric field shaper was used. Under these conditions, the particle emitter produced X-ray spectra measuring 127 keV. It should be understood that, though the above-described example used a pulse mode for applying alternating current to the transformer 20, amplitude or frequency modulated input modes can also be used.

Figure 5:
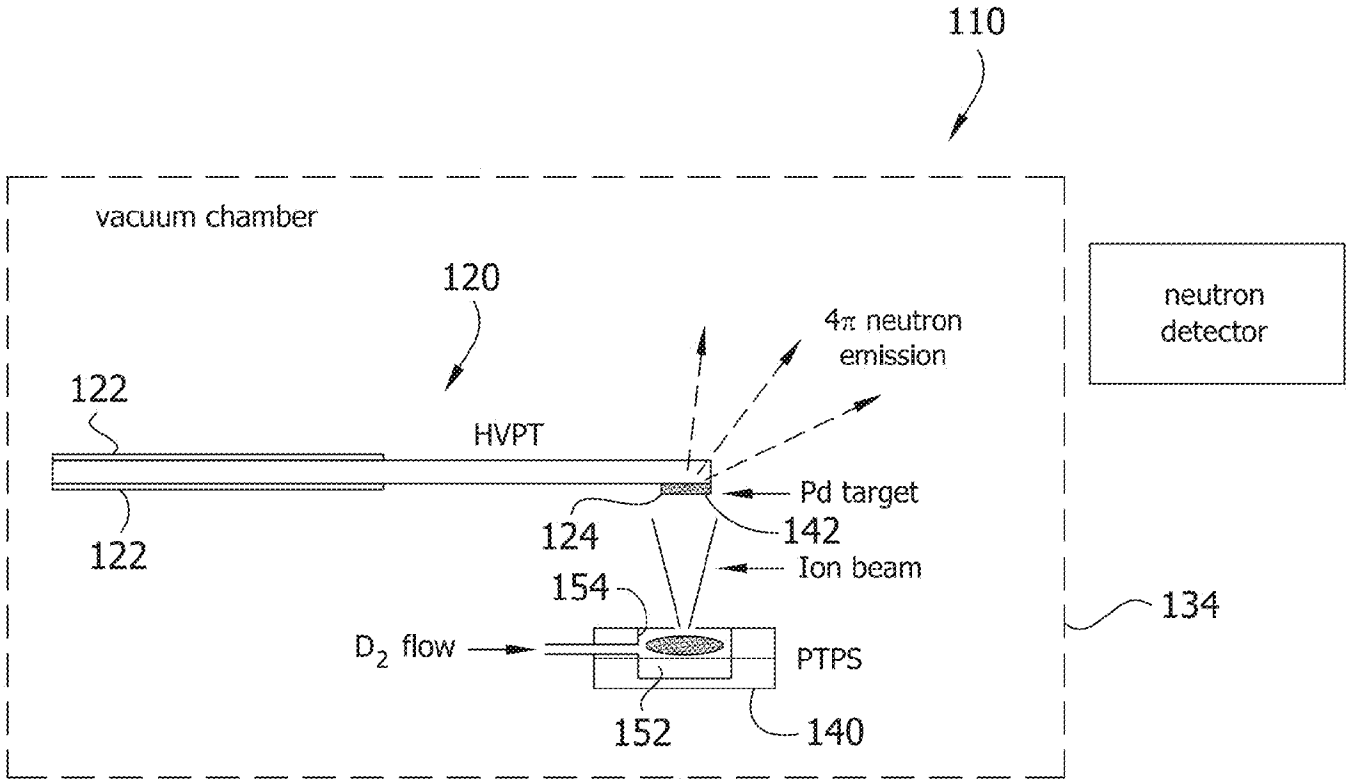
FIG. 5 is a schematic elevation of a piezoelectric transformer applied in a neutron emitter setup.

Turning now to FIG. 5, a low-power, compact particle emitter of an alternative embodiment is designated in its entirety by the reference number 110. The particle emitter 110 includes a piezoelectric transformer 120 with some features analogous to the transformer 20. Analogous features are referenced as indicated with respect to transformer 20, plus one-hundred. Like the above embodiments, the particle emitter 110 includes a piezoelectric transformer crystal 120 formed from a piezoelectric material. Unless otherwise indicated, features of the piezoelectric transformers discussed with respect to other embodiments of the present invention above, including preferred mounting mechanisms, input current specifications, field shapers, materials, etc. apply also to the transformer 120. Thus, the transformer 120 includes an input end and an output end, respectively attached to input electrodes 122 and an output electrode 124. In the illustrated embodiment however, the output electrode 124 is applied to a short length of the bottom side of the transformer 120.

As discussed in reference to the embodiments above, a current source should be connected to the input electrodes 122 at an input voltage transformed by way of the piezoelectric effect in the transformer 120 to a much higher output voltage at the output electrode 124. In the illustrated embodiment, however, the transformer 120 is not configured to emit an electron beam or X-rays. Rather, in combination with an ion source 140, the transformer 120 is configured to emit neutrons. One suitable ion source 140 may include the illustrated piezoelectric transformer plasma source. The piezoelectric transformer plasma source includes a piezoelectric transformer 152 configured to generate a high electric field in an aperture 154. A gas flow such as, for example, deuterium gas is supplied to the aperture 154. The high electric field in the aperture 154 causes ionization of the supplied deuterium gas. The ionization creates deuterium ions and electrons. The high electric field of the transformer 152, in combination with the high electric field of the transformer 120, causes the deuterium ions to be accelerated toward a palladium target on the output electrode 124 of the transformer 120. One skilled in the art will appreciate that if the polarity of the transformer 120 were reversed, the same set up could be used to accelerate the electrons generated by the ion source 140.

The piezoelectric transformer plasma source 140 is a particularly useful ion source because it can be precisely controlled. In other words, the piezoelectric transformer plasma source can be turned on to produce ions, or turned off, in which case it produces nothing. As discussed below, other ion sources may also be used without departing from the scope of the invention. Importantly, other ion sources should produce ions that can subsequently be accelerated in the form of an ion beam directed at an energized target to cause the emission of neutrons therefrom. Thus, preferably, an ion source such as the piezoelectric transformer plasma source 140 may produce ions that are accelerated in an ion beam moving along an ion beam path, where the ion beam comprises a plurality of charged particles. Moreover, preferably the ion target 142 should be positioned in the ion beam path so that the charged particles interact with the ion target to generate neutrons.

As with several of the above-discussed embodiments, the illustrated particle emitter 110, including both the transformer 120 and the ion source 140, may be positioned in an evacuated chamber 134 under a vacuum to improve performance. In one embodiment, deuterium ions may be accelerated from the ion source 140 toward a deuterium-doped palladium foil target 142. Other suitable targets such as titanium, scandium, and erbium targets are well known in the art. Any suitable target material may be used without departing from the scope of the present invention.

Figure 7:
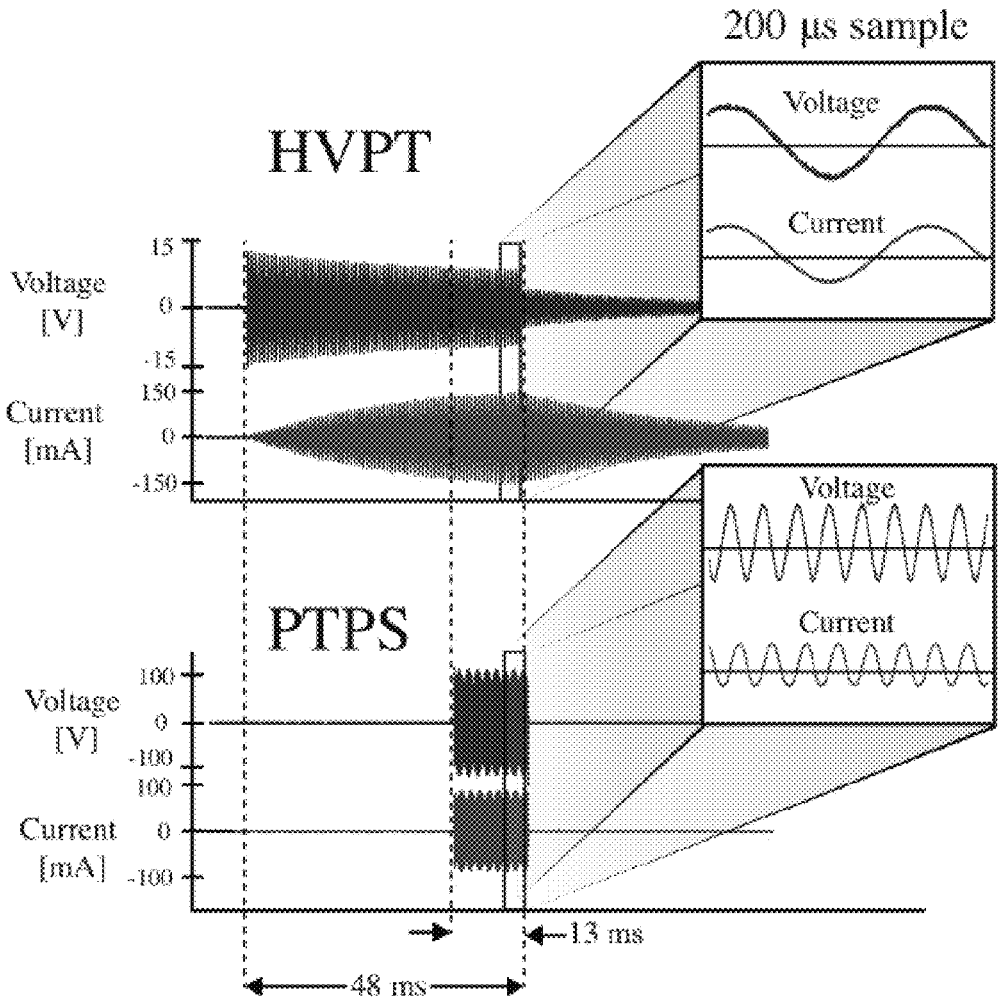
FIG. 7 is a graph showing one embodiment of fine timing.

In one embodiment such as is illustrated in FIG. 7, an alternating current applied to the transformer should be applied for a period of at least 30 ms prior to activating the ion source. As shown in FIG. 7, the transformer 20 (labeled HVPT) is activated for a period of 48 ms, while the transformer 152 of the ion source 140 (labeled PTPS) is only activated for a period of 13 ms. The transformer 152 of the ion source 140 is only activated at the end of the pulse activation of the transformer 120. In the illustrated embodiment, the energized deuterium atoms at the target 142 fuse with the deuterium ions accelerated from the ion source 140. Such a deuterium fusion reaction is known in the art to cause the emission of neutrons. Alternatively, other neutron generating reactions such as deuterium-tritium reactions or tritium-tritium reactions may also be used without departing from the scope of the invention.

In an alternative embodiment of a method of using the emitter 110, the electric field produced by the transformer 120 is reversed to attract the electrons produced by the piezoelectric transformer plasma source 140. In such an embodiment, the target 142 may be any suitable bremsstrahlung target. Thus, the transformer 120 should be configured to accelerate the electrons produced by the piezoelectric transformer plasma source 140 toward the bremsstrahlung target 142. As the electrons strike the target 142, they will produce X-ray radiation.

In an embodiment of an emitter in which the charged particle source is separated from the output of the transformer, such as the embodiments discussed above which incorporate a piezoelectric transformer plasma source 140, the timing of activation of the transformer with respect to the charged particle source may be coordinated. In order for the emitter 110 to produce either X-rays or neutrons, the energization of the transformer should be synchronized with the energization of the charged particle source. Basically, X-ray and neutron production occurs when the transformer 120 and the charged particle source 140 are simultaneously energized.

Particularly in the pulsed mode of operation, a piezoelectric transformer of the present invention may have a delayed transformational response. This means that the output of the transformer may not reach its maximum value immediately upon energization. For optimal production of neutrons or X-rays in the pulsed mode, charged particles can be emitted from a charged particle source when the transformer is at its full output voltage. Thus, in embodiments of the present invention in which the piezoelectric transformer is pulsed, charged particle source production should be delayed with respect to the energization of the transformer. Optimizing this period of delay may be referred to as fine timing. Because piezoelectric transformer plasma sources can be easily controlled or pulsed, they are a preferable choice for charged particle sources when fine timing optimization is important. In one preferred embodiment illustrated in FIG. 7, the pulse of a piezoelectric transformer plasma source may be delayed 60-80% of the duration of the pulse of the high voltage transformer. In FIG. 7 the charted voltage and current for the high voltage piezoelectric transformer and the piezoelectric transformer plasma source are indicative of input voltage. Thus, the short period of energization of the plasma source corresponds with a period in which the high voltage transformer is producing a maximum or near-maximum voltage output.

Referring to FIG. 6, one preferred embodiment of an x-ray emitter of the present invention is indicated generally at reference number 210. The particle emitter 210 includes a piezoelectric transformer 220 with some features analogous to the transformer 20. Analogous features are referenced as indicated with respect to transformer 20, plus two-hundred. Except as otherwise indicated, the transformer 220 can include any of the features discussed above in the description of the transmitter 20. The transformer 220 includes input electrodes 222 and an output electrode 224. The input electrodes 222 are coupled to an alternating current voltage source (not shown) that supplies an alternating current voltage at approximately two-times the resonant frequency of the transformer 20. The alternating current input can be amplitude modulated, frequency modulated, or pulsed. As discussed above, the transformer 220 outputs a voltage at the output electrode 224 that is much higher than the voltage supplied to the input electrodes 222. In the illustrated embodiment, the output electrode is located at the output end of the transformer 220 on a vertically oriented surface. One skilled in the art will appreciate that the output electrode can be attached to other surfaces of the output end without departing from the scope of the invention. A first pair of knife-edged mounting brackets 228A is secured to the transformer 20 at its one-quarter length, and a second pair of knife-edged mounting brackets 228B is secured to the transformer at its three-quarters length (mode 2 mounting). In the illustrated embodiment, the components of the x-ray emitter are contained in a vacuum chamber 234, preferably maintained at a pressure of less than about 9 mTorr. An electron source 240 is disposed in the vacuum chamber 234 oriented opposite the output end of the transformer 220. In a suitable embodiment, the electron source 240 is a thermionic emitter configured to emit a beam of electrons. However, other electron sources can also be used without departing from the scope of the invention. The electron source 240 is configured to emit a beam of electrons $e^-$ that is accelerated by an electric field created by the transformer 220 toward a bremsstrahlung target 242. The bremsstrahlung target 242 is attached to the output end of the transformer 20. When electrons $e^-$ strike the bremsstrahlung target 242, x-rays (labeled hv) are produced. As one skilled in the art will appreciate, x-rays can be used in, for example, imaging, fluoroscopy, and other applications.

In the illustrated embodiment, an electric field shaper 250 is used to manage the electric field produced by the transformer 220. The shaper 250 is a generally cylindrically shaped metal object or tube with open longitudinal ends. It is also contemplated that one or both longitudinal ends can be closed. The shaper 250 preferably houses (e.g., surrounds) a length of the transformer 220 adjacent the output end and likewise houses the electron emitter 240. The electric field shaper 250 can be a solid metal body shaped as an open-ended cylinder, an array of parallel metal wires that are collectively arranged as a cylinder, or any other metal structure arranged to surround portions of the emitter 210. The electric field shaper can be maintained at a slight potential with respect to ground, typically at a negative voltage, though the voltage control can be used to maintain the field shaper at a positive, negative, or grounded voltage without departing from the scope of the invention. The electric field shaper 250 fixes capacitive coupling between the output of the transformer 220 and ground at a low capacitance so that the voltage of the electric field produced by the transformer remains high. In addition, the electric field shaper 250 ensures a cylindrically symmetric electric field in the vacuum chamber 234. The electric field shaper can shape the electric field in the vicinity between the transformer 220 and the beam source 240 such that the beam is guided from the source to the target. This increases effectiveness because a higher fraction of the beam hits the target and produces useful radiations. Without field shaping, a transformer and beam source must be carefully aligned. Field shaping can simplify this effort, making the transformer and beam source easier to align.

Unlike piezoelectric transformer plasma sources, thermionic emitters, such as the electron source 240 of the embodiment of FIG. 6, cannot be abruptly turned on and off. Therefore, to achieve timing optimization in a pulsed mode of operation, a gating pulse apparatus, such as a pinhole or metallic mesh, is used to obstruct the electron beam such that it only emits electrons while the piezoelectric transformer is energized. Such gating mechanisms are well understood in the art, and therefore may be used in combination with the fine timing methods discussed above to optimize timing and maximize X-ray output. Moreover, because the thermionic emitter is capable of continuous electron emission, it is suitable for use with transformers activated in the frequency modulated or amplitude modulated modes discussed above. In these modes, a transformer constantly generates a fluctuating electric field. The field can be used to continuously accelerate the electrons produced by the thermionic emitter to continuously produce X-rays. As detailed in the table below, in experimentation, the emitter 210 has showed marked improvement in X-ray production when activated in amplitude and frequency modulated modes as compared with the pulsed mode.

| Drive Mode | X-ray Count Rate [$s^{-1}$] |
|---|---|
| Pulsed | 122 ± .32 |
| Amplitude Modulated | 2,426 ± 2.01 |
| Frequency Modulated | 8,752 ± 3.82 |

Having described the invention in detail, it will be apparent that modifications and variations are possible without departing from the scope of the invention defined in the appended claims.

When introducing elements of the present invention or the preferred embodiment(s) thereof, the articles "a", "an", "the", and "said" are intended to mean that there are one or more of the elements. The terms "comprising", "including", and "having" are intended to be inclusive and mean that there may be additional elements other than the listed elements.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. A low-power, compact piezoelectric neutron generator comprising:

a piezoelectric transformer crystal formed from a piezoelectric material having an input end and an output end;

an output electrode electrically connected to the output end;

a voltage source electrically connected to the input end to apply a first voltage to the crystal and create a second voltage that is higher than the first voltage at the output end caused by the piezoelectric effect, the second voltage creating an electric field generally originating at the output electrode; an ion source configured to produce a plurality of ions, the ions being accelerated as an ion beam by the electric field, the ion beam having an ion beam path; and, an ion target electrically connected to the output electrode, the ion target being positioned in the ion beam path so that the charged particles interact with the ion target to generate neutrons;

a vacuum chamber containing the piezoelectric transformer crystal, the ion source and the ion target.

2. The neutron generator of claim 1 wherein the ion source comprises a piezoelectric transformer plasma source.

3. The neutron generator of claim 2 wherein the piezoelectric transformer plasma source comprises a piezoelectric transformer configured to generate a high electric field in an aperture and a gas flow supplied to the aperture, the high electric field of the piezoelectric transformer plasma source being configured to cause ionization of gas supplied to the aperture by the gas flow.

4. A low-power, compact emitter of atomic particles comprising:

a piezoelectric transformer crystal formed from a piezoelectric material having an input end and an output end;

an output electrode electrically connected to the output end;

a voltage source electrically connected to the input end to apply a first voltage to the crystal and create a second voltage that is higher than the first voltage at the output end caused by the piezoelectric effect, the second voltage creating an electric field generally at the output electrode;

a charged particle source for emitting charged particles; and, a target for receiving the charged particles;

a vacuum chamber containing the piezoelectric transformer crystal, the charged particle source and the target;

whereby in operation the electric field accelerates the charged particles toward the target such that the charged particles interact with the target to emit one of neutrons and X-rays.

5. The emitter of claim 4 wherein the piezoelectric transformer crystal has a length, a width, and a height, and the crystal is configured for electric transformation in a length extensional mode.

6. The emitter of claim 5 wherein the piezoelectric transformer crystal has a crystallographic polarization being rotated 45° from vertical about a width-wise axis of the crystal.

7. The emitter of claim 5 wherein the piezoelectric transformer crystal is mounted between brackets at its mid length.

8. The emitter of claim 7 wherein the voltage source is an alternating current voltage source having a frequency equal to about a resonant frequency of the piezoelectric transformer crystal.

9. The emitter of claim 4 wherein the piezoelectric transformer crystal is mounted between brackets at its one-quarter length and other brackets at its three-quarters length.

10. The emitter of claim 9 wherein the voltage source is configured to supply an alternating current voltage having a frequency equal to about two times a resonant frequency of the piezoelectric transformer crystal.

11. The emitter of claim 4 wherein the voltage source is configured to supply an alternating current voltage to the input end of the piezoelectric crystal in an amplitude modulated mode.

12. The emitter of claim 4 wherein the voltage source is configured to supply an alternating current voltage source to the input end of the piezoelectric crystal in a frequency modulated mode.

13. The emitter of claim 4 further comprising an electric field shaper.

14. The emitter of claim 13 wherein the electric field shaper houses a length of the piezoelectric transformer crystal adjacent the output end, the charged particle source, and the target.

15. The emitter of claim 13 wherein the electric field shaper includes a voltage control configured to maintain the electric field shaper at a voltage relative to ground.

16. The emitter of claim 4 wherein the charged particle source is positioned at the output electrode of the piezoelectric transformer crystal and the target is spaced apart therefrom.

17. The emitter of claim 4 wherein the target is positioned at the output electrode of the piezoelectric transformer crystal and the charged particle source is spaced apart therefrom.

18. A low-power, compact piezoelectric X-ray generator comprising:

a piezoelectric transformer crystal formed from a piezoelectric material having an input end and an output end;

an output electrode electrically connected to the output end;

a voltage source electrically connected to the input end to apply a first voltage to the crystal and create a second voltage that is higher than the first voltage at the output end caused by to the piezoelectric effect, the second voltage creating an electric field generally at the output electrode;

an electron emitter configured to emit a beam of electrons accelerated by the electric field;

a bremsstrahlung target positioned in the electron beam so that the electrons interact with the target to generate X-rays;

a vacuum chamber containing the piezoelectric transformer crystal, the electron emitter and the bremsstrahlung target.

19. The X-ray generator of claim 18 wherein the electron emitter comprises a thermionic emitter spaced apart from the output electrode.

20. The X-ray generator of claim 18 wherein the electron emitter comprises a high field electron emitter electrically connected to the output electrode.

* * * * *